US005338104A

United States Patent [19]

Bewick

[11] Patent Number: 5,338,104

[45] Date of Patent: Aug. 16, 1994

[54] AUXILIARY CUTTER FOR A MINING MACHINE HAVING COAXIAL CUTTER DRUMS

[75] Inventor: Colin Bewick, Worksop, Great Britain

[73] Assignee: Anderson Group Limited, Glasgow, United Kingdom

[21] Appl. No.: 74,876

[22] PCT Filed: Jan. 27, 1992

[86] PCT No.: PCT/GB92/00149

§ 371 Date: Jun. 16, 1993

§ 102(e) Date: Jun. 16, 1993

[87] PCT Pub. No.: WO92/14035

PCT Pub. Date: Aug. 20, 1992

[30] Foreign Application Priority Data

Feb. 6, 1991 [GB] United Kingdom ..... 9102571.8

[51] Int. Cl.[5] ..... E21C 25/10

[52] U.S. Cl. ..... 299/85; 299/89

[58] Field of Search ..... 299/71, 80, 85, 89

[56] References Cited

U.S. PATENT DOCUMENTS

| | | | |
|---|---|---|---|
| 3,052,454 | 9/1962 | Sibley | 299/71 |
| 3,279,856 | 10/1966 | Silks | 299/85 |

FOREIGN PATENT DOCUMENTS

| | | | |
|---|---|---|---|
| 3737864 | 5/1989 | Fed. Rep. of Germany | 299/89 |
| 443971 | 6/1975 | U.S.S.R. | 299/89 |
| 509717 | 6/1976 | U.S.S.R. | 299/85 |
| 619646 | 8/1978 | U.S.S.R. | 299/89 |
| 1097787 | 6/1984 | U.S.S.R. | 299/89 |

*Primary Examiner*—David J. Bagnell
*Attorney, Agent, or Firm*—Lane, Aitken & McCann

[57] ABSTRACT

A mining machine has a forward rotating cutter head mounted on a boom. The cutter head comprises at least two cutter drums in co-axial end to end formation and spaced apart by an arm of the boom. An auxiliary cutter device is located in the space between the drums and is adapted for intermittent engagement of the coal face when the cutter drums are cutting.

3 Claims, 2 Drawing Sheets

AUXILIARY CUTTER FOR A MINING MACHINE HAVING COAXIAL CUTTER DRUMS

BACKGROUND OF THE INVENTION

This Invention relates to mining machines, and in particular to mining machines having a forward rotating cutter head.

Such cutter heads are mounted on a boom which in use traverses across and up and down to draw the cutter head across the coal face.

The cutter head lies traversely of the boom formed of two or more cutter drums spaced end to end and separated by the width of an arm of the boom, the space between drums being a variable, but by way of example in the region of 28 cm (11"). There my be two drums with the boom arm therebetween, or three drums, namely a central drum located between two arms of the boom and two outer drums each spaced from the central drum by one of the arms.

During cutting, the areas of the coal face opposite the space between the drums are not directly cut by the drums and it is left to chance that they fall away with the cut coal. Alternatively either the boom or the machine must be moved in order that this material be cut by the cutter

SUMMARY OF THE INVENTION

An object of this invention is to provide apparatus to positively remove the coal between but not directly cut by the cutter drums.

According to the present invention there is provided a mining machine having a forward rotating cutter head mounted on a boom, said cutter head comprising at least two cutter drums in co-axial end to end formation and spaced apart by an arm of the boom, wherein an auxiliary cutter device is located in the space between the drums and adapted for intermittent engagement of the coal face when the cutter drums are cutting and includes a pick carrying arcuate member to which an oscillatory motion is applied on rotation of the cutter drums, the auxiliary cutter device being a cutter ring having an eccentric rotor fixedly attached to at least one drum and a stator mounted on the rotor for oscillatory motion when the rotor is rotated, said stator engaging the boom to restrain rotation with the rotor.

Preferably also, the stator comprises an arcuate plate which locates partially around the boom arm and carries picks which extend upwards, forwards and downwards, and bracket means for engagement with the boom.

Preferably, such bracket means mounts guide means for engagement with the boom, said guide means guiding the stator in its oscillatory motion.

In use the eccentric rotor rotates with the cutter drums and causes the stator to oscillate; this causes each pick to move in a small circular motion and 'claw' at the coal face to remove coal not already removed by the cutter drums.

DESCRIPTION OF THE PREFERRED EMBODIMENTS

Figure 1:
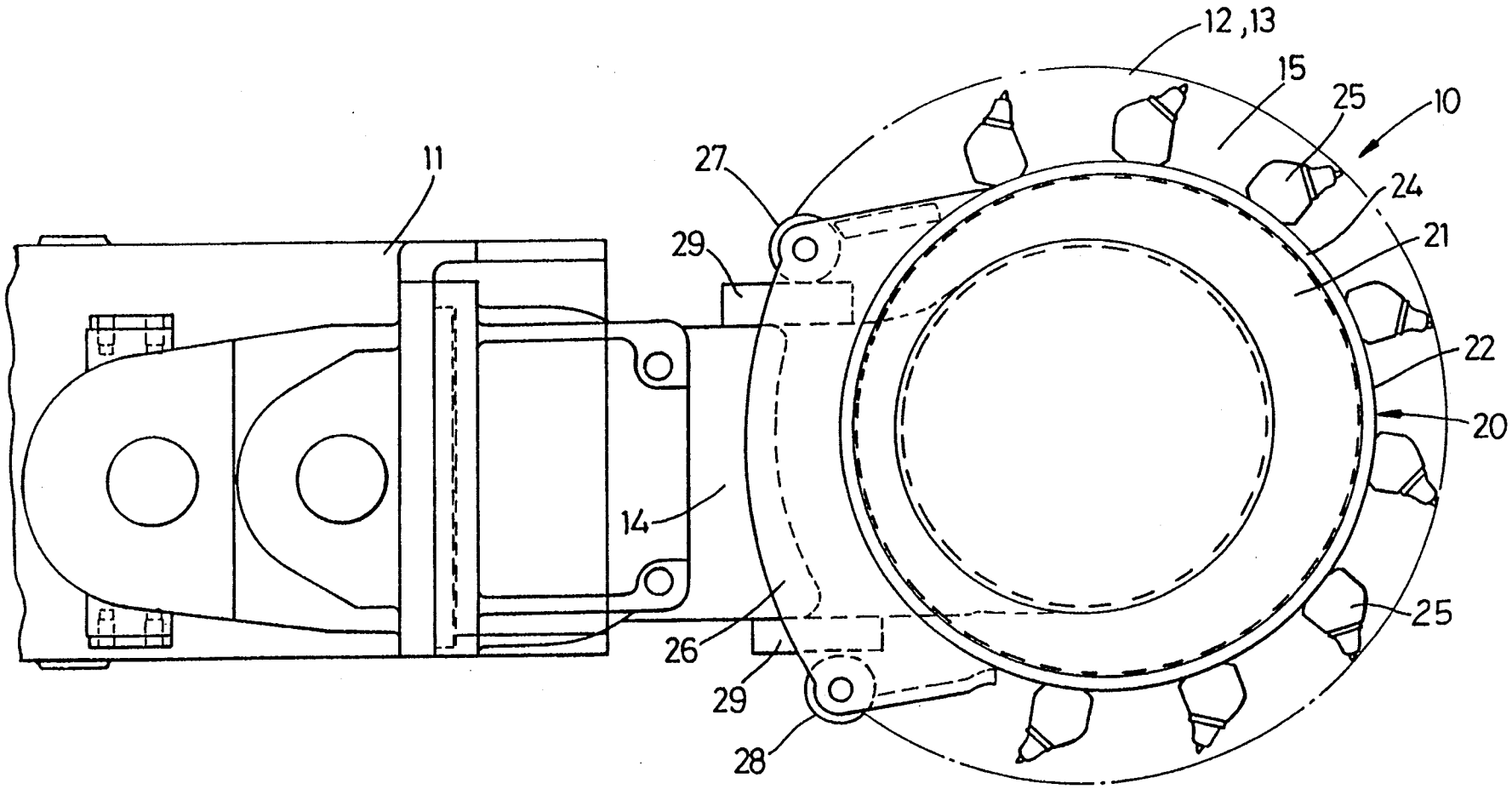
Figure 2:
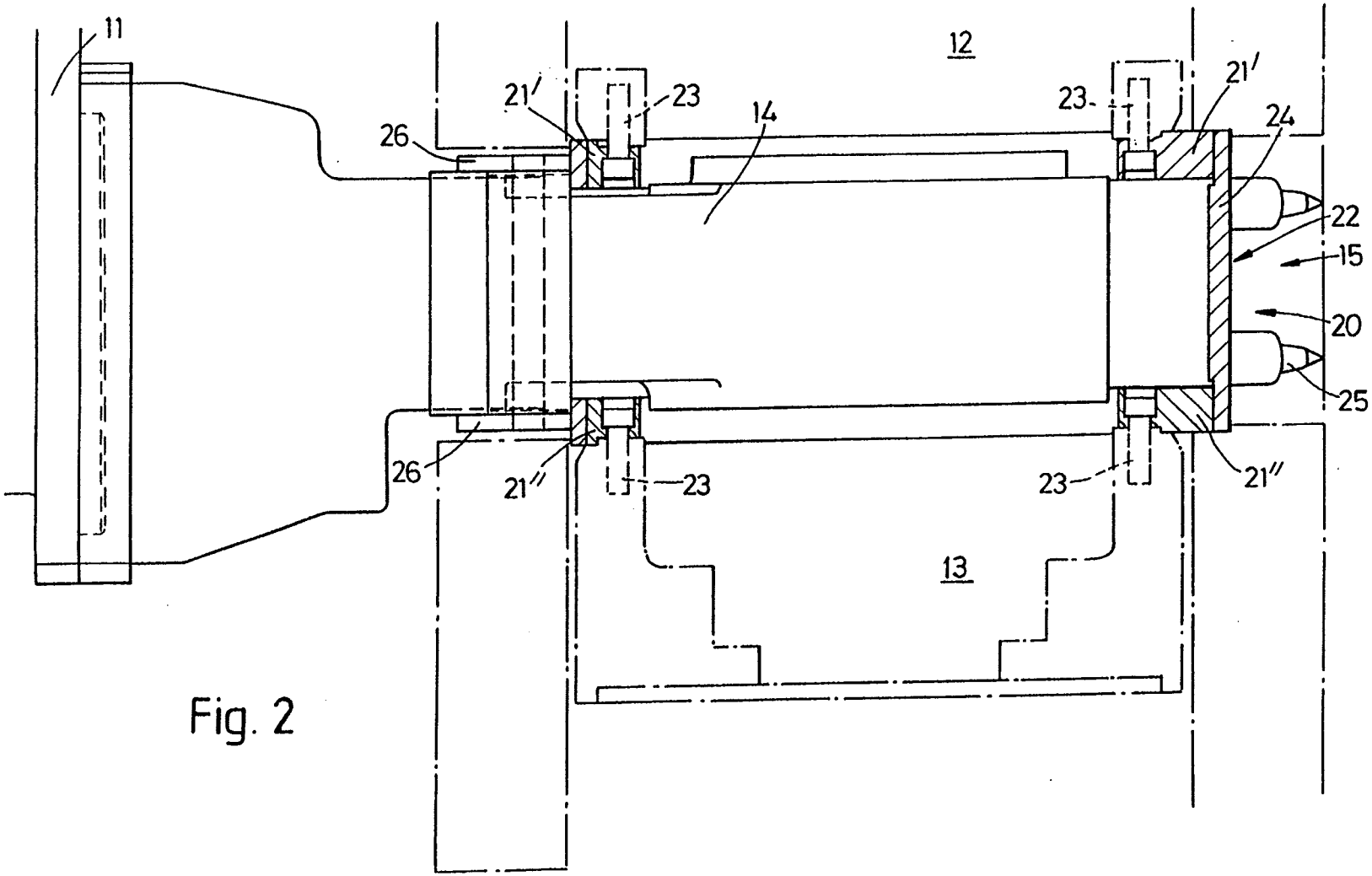

An embodiment of the present invention will now be described, by way of example, with reference to the accompanying drawings, in which:

FIG. 1 is a side elevation of part of the boom and the cutter head of a mining machine according to the invention; and FIG. 2 is a plan view of FIG. 1.

Referring to the drawings, the mining machine has a forward rotating cutter head 10 mounted on a boom 11.

In this embodiment two cutter drums 12, 13 are provided spaced apart by a boom arm 14 which carries the drums and transmits the power to rotate the drums when in use.

Thus there is a space 15 between the cutter drums, that space being for example about 28 cm (11").

In accordance with the invention a cutter ring 20 is located in that space in order to positively remove material not cut by the cutter drums.

The cutter ring comprises an eccentric inner rotor 21 and an outer stator 22.

The rotor 21 comprises two identical eccentric rings 21' 21" each of which is bolted by bolts 23 to the side of a drum 12, 13 to rotate with these drums.

The stator 22 includes an arcuate plate 24 which overlies a major arc of the rotor rings and extends from above to below the boom arm 14. Said plate 24 carries picks 25 which extend upwards, forwards and downwards. The stator 22 also includes a pair of parallel arcuate brackets 26 which extend between the ends of the arcuate plate at opposed sides of the stator. These plates lie alongside the boom arm 14 and carry a pair of transverse guide rollers 27, 28 which locate above and below the boom arm 14, and engage blocks 29 on the arm 14. In one arrangement only one guide roller at a time engages its blocks, as illustrated in FIG. 1, the other roller being slightly spaced from its block. Alternatively, the blocks may be profiled to provide constant engagement by both rollers.

In use, the eccentric rotor rotates with the rotating drums and imparts and oscillatory motion to the stator. This causes the picks 25 of the cutter ring 20 to move in a small circular path of, e.g. 40 mm and at the forward limit of their motion they 'claw' at the coal face to remove the area of coal not directly cut by the cutter drums 12, 13. As the stator oscillates the guide rollers run back and forth along or adjacent to their blocks.

I claim:

1. A mining machine having a forward rotating cutter head mounted on a boom, said cutter head comprising at least two cutter drums in co-axial end to end formation and spaced apart by an arm of the boom, wherein an auxiliary cutter device is located in the space between the drums and adapted for intermittent engagement of the coal face when the cutter drums are cutting and includes a pick carrying arcuate member to which an oscillatory motion is applied on rotation of the cutter drums, the auxiliary cutter device being a cutter ring having an eccentric rotor fixedly attached to at least one drum and a stator mounted on the rotor for oscillatory motion when the rotor is rotated, said stator engaging the boom to restrain rotation with the rotor.

2. A mining machine according to claim 1, wherein the stator comprises an arcuate plate which locates partially around the boom arm and carries picks which extend upwards, forwards and downwards, and bracket means for engagement with the boom.

3. A mining machine according to claim 2, wherein the bracket means mounts guide means for engagement with the boom, said guide means guiding the stator in its oscillatory motion.

* * * * *